US005163738A

United States Patent [19]

Linsingen-Heintzmann

[11] Patent Number: 5,163,738

[45] Date of Patent: Nov. 17, 1992

[54] APPARATUS FOR MINING A SEAM, IN PARTICULAR OF COAL

[76] Inventor: Peter V. Linsingen-Heintzmann, Zum Ruhrblick 4,, D-4630 Bochum 1, Fed. Rep. of Germany

[21] Appl. No.: 735,414

[22] Filed: Jul. 24, 1991

[30] Foreign Application Priority Data

Jul. 31, 1990 [DE] Fed. Rep. of Germany ..... 4024250

[51] Int. Cl.[5] ..... E21D 23/00; E21D 27/32

[52] U.S. Cl. ..... 299/10; 299/33; 299/34

[58] Field of Search ..... 299/1.6, 1.7, 10, 32, 299/33, 34

[56] References Cited

U.S. PATENT DOCUMENTS 4,029,361 6/1977 Beckmann et al. ..... 299/33 X

FOREIGN PATENT DOCUMENTS 181799 5/1986 European Pat. Off. ..... 299/33
1040172 9/1983 U.S.S.R. ..... 299/34
1585513 8/1990 U.S.S.R. ..... 299/34

*Primary Examiner*—David J. Bagnell
*Attorney, Agent, or Firm*—Herbert Dubno; Andrew Wilford

[57] ABSTRACT

A mining apparatus for working a horizontally and longitudinally extending seam having a vertical face has a longitudinal row of walking props extending along the face and each having a roof-engaging cap, a floor-engaging foot, and a jack vertically interconnecting the respective cap and foot and expansible to press the cap up and foot down. Upper and lower long-wall mining machines each having a predetermined height substantially less than the distance between the mine roof and floor are each provided with a cutter for working the face and a longitudinal conveyor for carrying off material cut from the face. The upper machine is suspended from the caps well above the floor level and the lower machine is carried on the feet of the promps below the caps thereof generally at floor level and spaced back towards the props from the props so that the upper machine moves on a step above the lower machine and the two machines can simultaneously work the seam at respective vertically and horizontally offset levels.

14 Claims, 4 Drawing Sheets

APPARATUS FOR MINING A SEAM, IN PARTICULAR OF COAL

FIELD OF THE INVENTION

The present invention relates to an apparatus for and method of long-wall mining. More particularly this invention concerns working a horizontal seam of coal or the like by underhand stoping.

BACKGROUND OF THE INVENTION

In commonly owned U.S. Pat. No. 4,883,322 a mining apparatus is described for removing stratified outcropped minerals and for transporting these minerals parallel to the mining face or breast. This apparatus comprises a digging portion and a conveyor portion as well as a chain conveyor guided positively in them with digging tools and carrier members. The digging portion and the conveyor portion are assembled together from a plurality of pan-like members. Each pan of the conveyor portion comprises a conveying trough made from two guide pieces which are mirror images of each other attached to a base plate and from two identical bent plates. The guide pieces engage in members in the bent plates and are clamped with them by clamping plates on the top side of the bent plates. The digging portion has a guide piece identical with the guide piece of the conveyor portion. A basin-like plate of the digging portion is pivotably mounted by a welded substantially circular cross section strip on the breast wall side of the conveyor portion. Coupling members for the adjacent pan-like members of the conveyor portion are located under the bent plates.

Such an apparatus is typically mounted on a row of walking roof supports or props each having a floor-engaging foot, a roof-engaging head, and jack structure between them that presses the head up and the foot down to hold up the roof or hanging wall as the seam is being cut away. Such a row of walking props is lined up along to the long face wall and the props are individually pulled toward the face by respective hydraulic rams as the face is cut away to advance them and hold up the newly exposed roof. When the props are braced vertically between the roof and floor, the same rams can be used to move the mining apparatus and its conveyor forward toward the seam.

Such systems can only work over seams some 0.7 m to 1.2 m high efficiently. When the seam is taller it is necessary to use a different cutting machine or to provide an adapter for reaching the higher levels. The cutters that can work taller seams are very expensive to manufacture and cannot be used on normal-height seams, so that it they are not normally economically worthwhile.

OBJECTS OF THE INVENTION

It is therefore an object of the present invention to provide an improved apparatus and method for working a tall seam.

Another object is the provision of such an improved apparatus for working a tall seam which overcomes the above-given disadvantages, that is which efficiently works an overheight seam, but that can also be used for normal-height seams.

SUMMARY OF THE INVENTION

A mining apparatus for working a horizontally and longitudinally extending seam having a vertical face has a longitudinal row of walking props extending along the face and each having a roof-engaging cap, a floor-engaging foot, and a jack vertically interconnecting the respective cap and foot and expansible to press the cap up and foot down. Upper and lower long-wall mining machines each having a predetermined height substantially less than the distance between the mine roof and floor are each provided with a cutter for working the face and a longitudinal conveyor for carrying off material cut from the face. The upper machine is suspended from the caps well above the floor level and the lower machine is carried o the feet of the props below the caps thereof generally at floor level and spaced back toward the props from the props so that the upper machine moves on a step above the lower machine and the two machines can simultaneously work the seam at respective vertically and horizontally offset levels.

With this system, therefore, conventional-height mining machines can work together on a face that is much higher than either of them could work alone. The machines can make respective cuts that vertically overlap or these cuts can be vertically spaced. In the latter case the intervening ridge of rock can easily be broken down to be taken up by the lower machine, and in practice normally will fall down as it is undercut.

The inventive procedure is different from the underhand stoping normally done in open-pit operations. In them the individual levels are worked independently. According to the instant invention they are cut away and advanced simultaneously and synchronously. This preserves the efficiency of long-wall-mining with a single double-height cutter while avoiding the extra expense of this equipment.

According to the invention the props each include a roof-engaging shield and means for horizontally shifting the shield toward the face, the suspension means supporting the upper machine directly on the shields. Furthermore the upper machine, suspension means, and shield are pivoted on the cap about a longitudinal and horizontal axis. Each cutting machine includes scrapers and means can be provided for vertically displacing the upper machine relative to the caps.

It is also within the scope of this invention to use an intermediate long-wall mining machine having a predetermined height substantially less than the distance between the mine roof and floor and provided with a cutter for working the face and a longitudinal conveyor for carrying off material cut from the face. Intermediate suspension means hang the intermediate machine from the caps well above the floor level but below the upper machine.

According to another feature of this invention when the face includes a horizontally extending seam of nonore material vertically flanked by two seams of minable grade material an intermediate mining machine like the upper and lower machines is suspended from the caps and is used to cut away and remove the nonore material. In this case the upper and lower machines cutting away and removing the grade material above and below the nonore material. Thus the nonore seam can be kept segregated from the ore, which term is here intended to cover coal which is the main application of the instant invention.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
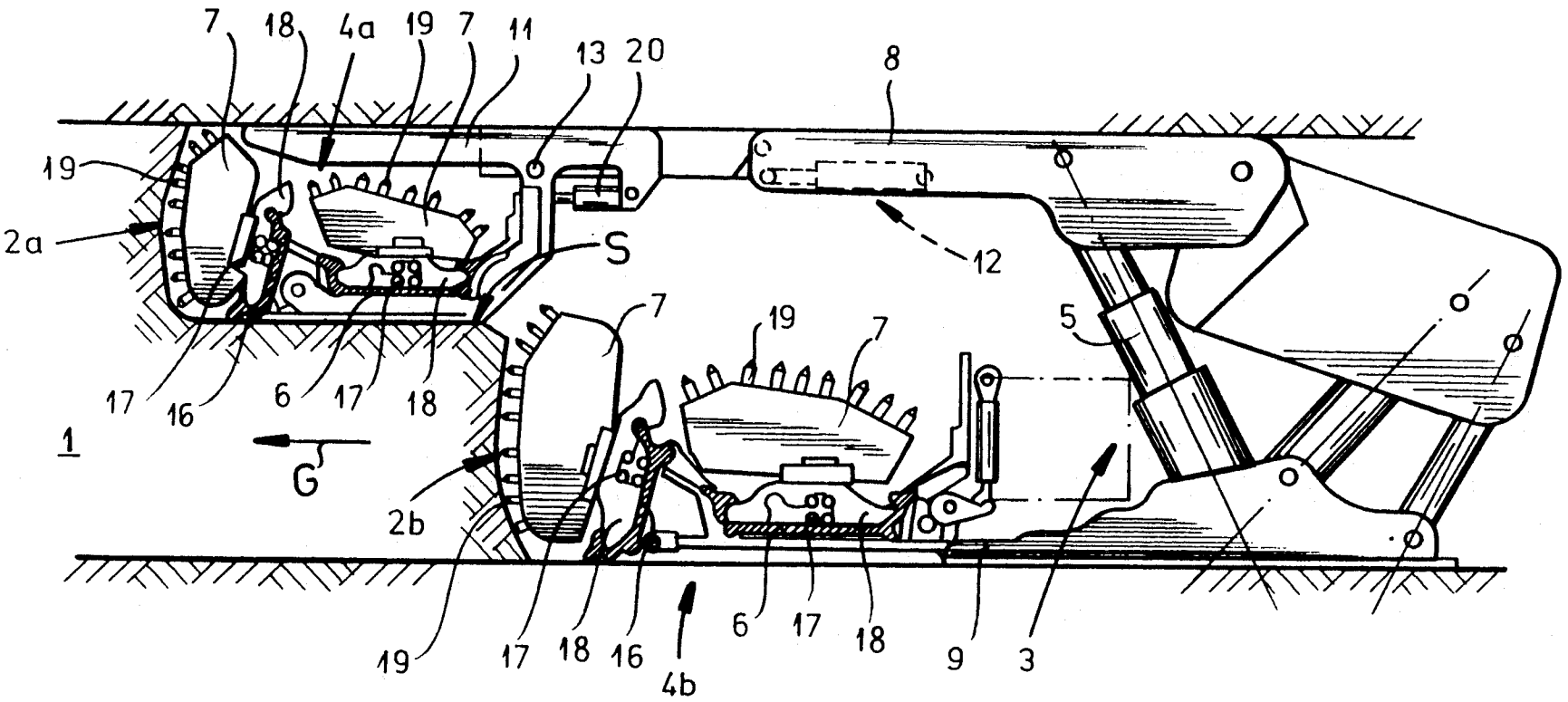
FIG. 1 is a small-scale and partly diagrammatic side view of the apparatus for carrying out the method of this invention.

As seen in FIG. 1 a generally horizontal and longitudinally extending coal seam 1 is worked in two separate faces 2*a* and 2*b* separated by a step S. The faces 2*a* and 2*b* are worked by respective upper and lower mining machines 4*a* and 4*b* of the type described in the above-mentioned patent and each having a conveyor 6 extending longitudinally (perpendicular to the plane of the view in FIG. 1) along the respective faces 2*a* and 2*b* and cutters 7. The conveyors 6 each comprise a trough 16 in which a chain 17 provided with entrainment elements 18 is provided. The cutters 7 have teeth 19.

A row of walking props 3 each having a roof-engaging cap 8, a floor-engaging foot 9, and a hydraulic jack arrangement 5 between them is provided to support the roof of the mine adjacent the working area. As is known the props 3 are stepped transversely in the direction G toward the seam 1 as same is cut away by relaxing the jacks 5 sequentially, pulling them forward one at a time, then repressurizing the jacks 5 to maintain roof support. The region behind the props 3 can be filled with burden as a goaf, can be permanently propped up, and/or can be stabilized with rock bolts. In addition a hydraulic actuator 12 in the cap 8 can extend the shield 11 to transversely advance the upper machine 4*a* somewhat without having to move the entire prop 3. Similarly another jack 20 can pivot the shield 11 and the machine 4*a* about the axis 13 as needed. This allows the shields 11 and caps 8 to be lowered to advance the individual props without vertically changing the position of the respective portion of the machine 4*a*.

Figure 2:
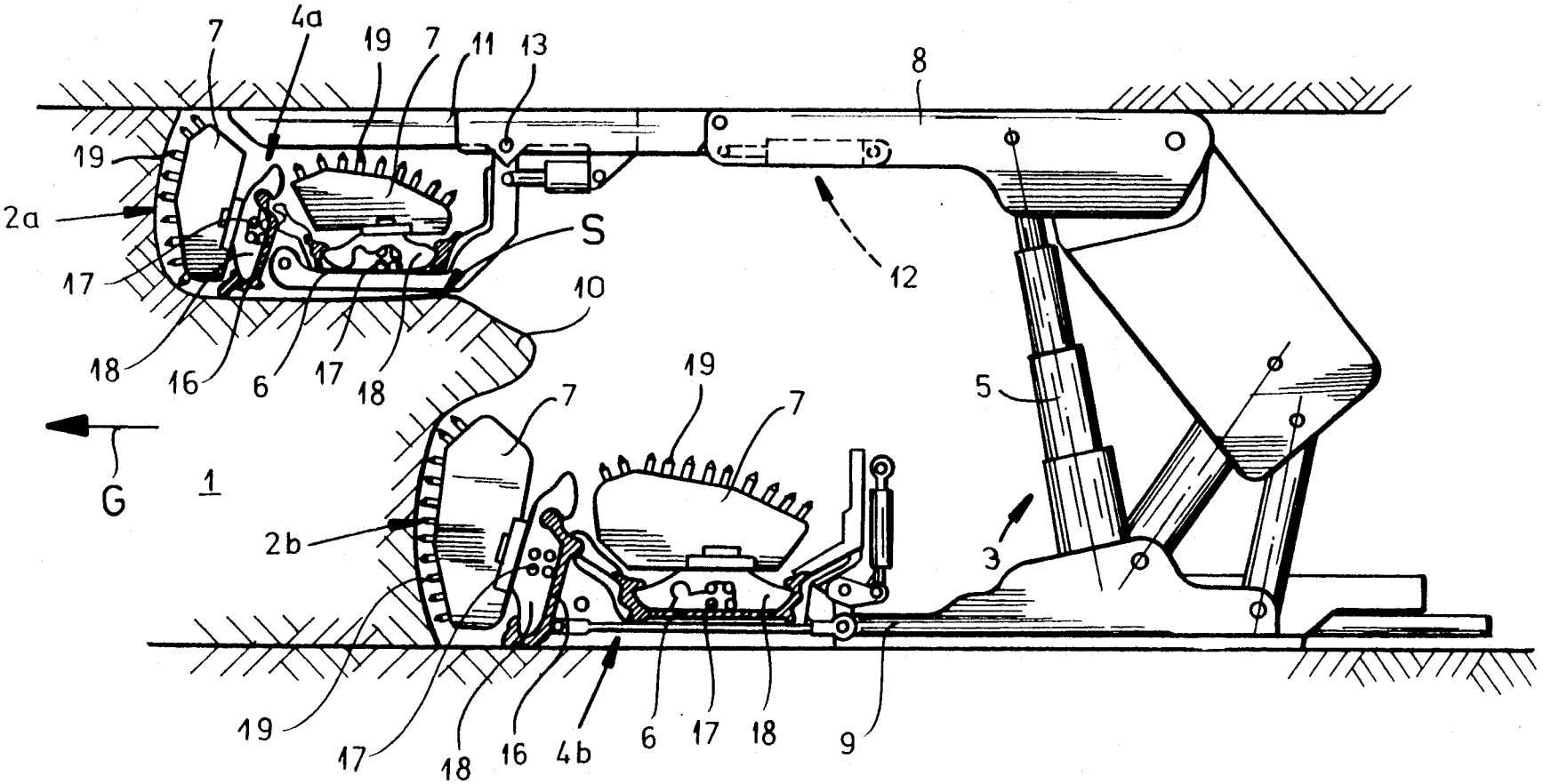
FIG. 2 is a view like FIG. 1 illustrating another use of the apparatus.

The upper mining machine 4*a* is suspended from a shield 11 pivotal about a longitudinal axis 13 on the cap 8. This machine 4*a* rides on the step S. The lower machine 4*b* is mounted on the feet 9 and as seen in FIG. 1 its cut vertically overlaps that of the upper machine. FIG. 2 shows another setup where the cap 8 and shield 11 are higher so that the upper and lower faces 2*a* and 2*b* are vertically spaced, leaving a protruding portion 10 that can be broken off to drop down into the conveyor 6 of the lower machine 4*b*.

Figure 3:
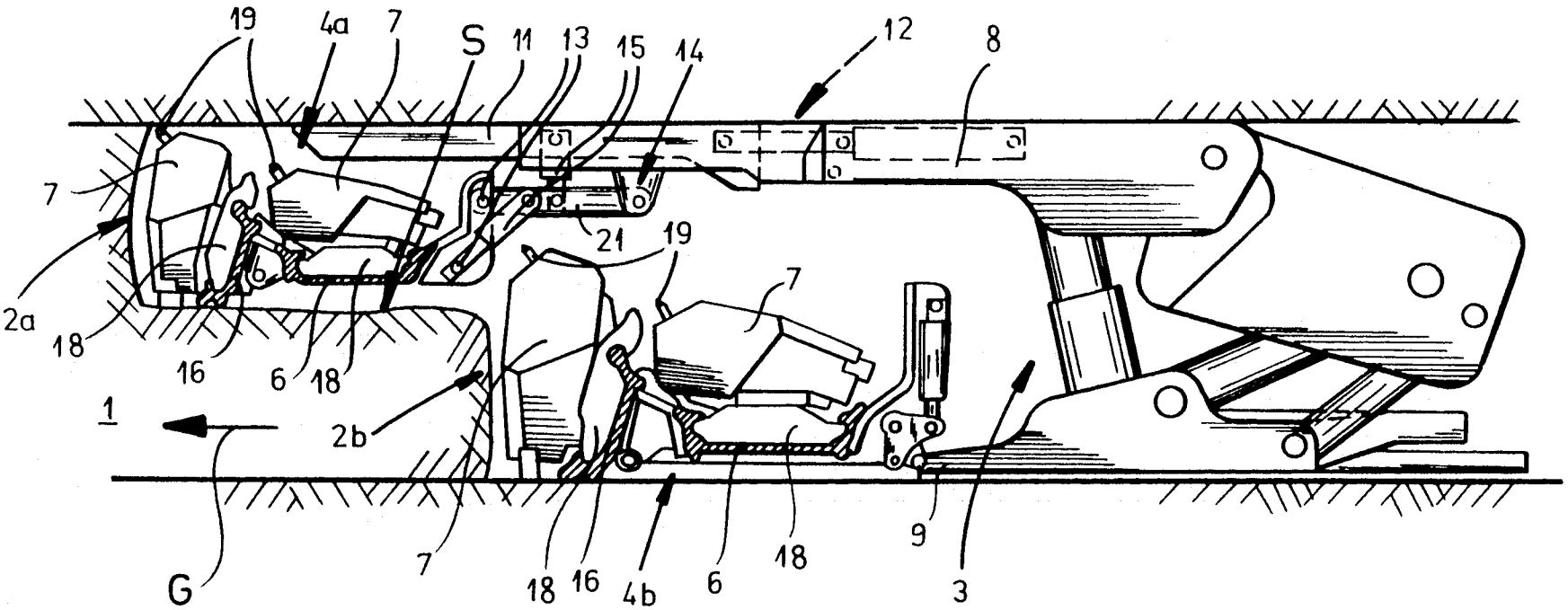
FIGS. 3 and 4 are views like FIG. 1 of other apparatuses according to the invention.

FIG. 3 shows a lever arrangement 21 associated with the actuators 14 and 15 to allow the vertical height of the upper machine 4*a* to be adjusted somewhat independently of the vertical position of the shield 11. This is handy when the props 3 are being advanced as it allows a cap 8 be dropped down as the respective prop 3 is stepped forward in direction G without affecting the vertical position of the machine 4*a*.

Figure 4:
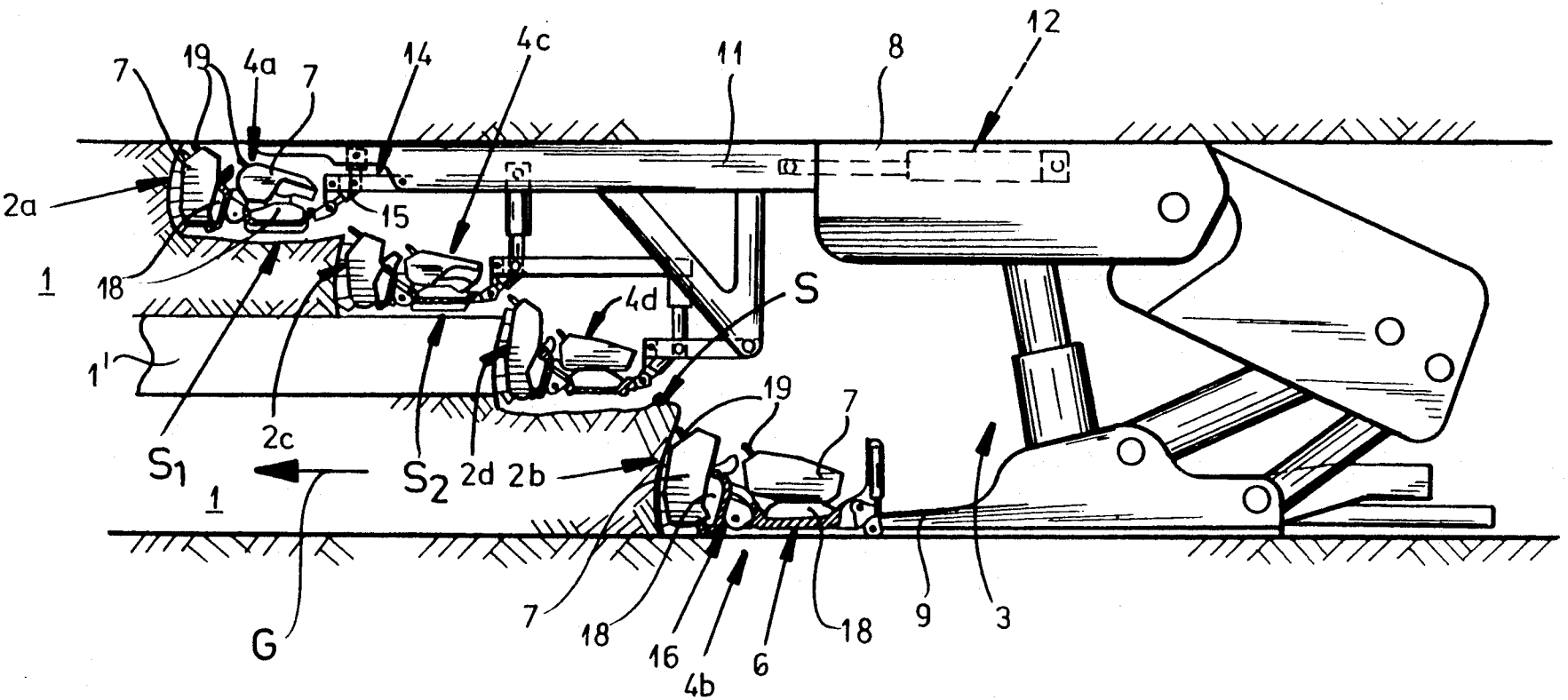

In FIG. 4 the coal seam 1 is interrupted by a seam 1' of nonore rock. In addition the shield 11 carries, in addition to the upper machine 4*a*, intermediate machines 4*c* and 4*d* that form steps $S_1$ and $S_2$ while cutting away faces 2*c* and 2*d* in an underhand stoping operation. The face 2*d* is at the level of the nonore seam 1' so that this useless material can be removed separately and maintained segregated from the ore of the faces 2*a*, 2*b*, and 2*d*. Individual jack arrangements 14 and 15 control the vertical height and angular orientation of the upper and intermediate cutters 4*a*, 4*c*, and 4*d*.

I claim:

1. A mining apparatus for working a horizontally and longitudinally extending seam having a vertical face comprises:

a longitudinal row of walking props extending along the face and each having a roof-engaging cap, a floor-engaging foot, and a jack vertically interconnecting the respective cap and foot and expansible to press the cap up and foot down;

upper and lower long-wall mining machines each having a predetermined height substantially less than the distance between the mine roof and floor and each provided with a cutter for working the face and a longitudinal conveyor for carrying off material cut from the face;

suspension means for hanging the upper machine from the caps well above the floor level; and means for carrying the lower machine on the feet of the props below the caps thereof generally at floor level and spaced back toward the props from the props so that the upper machine moves on a step above the lower machine, whereby the two machines can simultaneously work the seam at respective vertically and horizontally offset levels.

2. The mining apparatus defined in claim 1 wherein the machines make respective cuts that vertically overlap.

3. The mining apparatus defined in claim 1 wherein the machines make respective cuts that are vertically spaced.

4. The mining apparatus defined in claim 1 wherein the props each include a roof-engaging shield and means for horizontally shifting the shield toward the face, the suspension means supporting the upper machine directly on the shields.

5. The mining apparatus defined in claim 4 wherein the upper machine, suspension means, and shield are pivoted on the cap about longitudinal and horizontal axis.

6. The mining apparatus defined in claim 1 wherein each cutting machine includes scrapers.

7. The mining apparatus defined in claim 1 wherein the suspension means includes means for vertically displacing the upper machine relative to the caps.

8. The mining apparatus defined in claim 1, further comprising:

an intermediate long-wall mining machine having a predetermined height substantially less than the distance between the mine roof and floor and provided with a cutter for working the face and a longitudinal conveyor for carrying off material cut from the face; and intermediate suspension means for hanging the intermediate machine from the caps well above the floor level but below the upper machine.

9. The mining apparatus defined in claim 1 wherein each mining machine can cut a swathe of a predetermined height that is substantially less than the vertical distance between the mine roof and floor.

10. A mining method for working a horizontally and longitudinally extending seam having a vertical face adjacent a mine having a roof and a floor, the method comprising the steps of:

supporting the roof adjacent the face with a longitudinal row of walking props extending along the face and each having a roof-engaging cap, a floor-engaging foot, and a jack vertically interconnecting the respective cap and foot and expansible to press the cap up and foot down;

simultaneously working the face at vertically and horizontally offset locations with upper and lower long-wall mining machines each having a predetermined height substantially less than the distance between the mine roof and floor and each provided with a cutter for working the face and a longitudinal conveyor for carrying off material cut from the face;

suspending the upper machine from the caps well above the floor level; and supporting the lower machine on the feet of the props below the caps thereof generally at floor level and spaced back toward the props from the props so that the upper machine moves on a step above the lower machine, whereby the two machines can simultaneously work the seam at respective vertically and horizontally offset levels.

11. The mining method defined in claim 10 wherein the machines make respective cuts that vertically overlap.

12. The mining method defined in claim 10 wherein the machines make respective cuts that are vertically spaced.

13. The mining method defined in claim 12 wherein the face includes a horizontally extending seam of nonore material vertically flanked by two seams of minable grade material, the method further comprising the step of:

suspending an intermediate mining machine like the upper and lower machines from the caps and using it to cut away and remove the nonore material, the upper and lower machines cutting away and removing the grade material above and below the nonore material.

14. The mining method defined in claim 10, further comprising the step of:

bracing the props between the mine roof and floor and transversely displacing the machines relative to the braced props.

* * * * *